US006289662B1

(12) United States Patent
Dinkelmann et al.

(10) Patent No.: US 6,289,662 B1
(45) Date of Patent: Sep. 18, 2001

(54) METHOD OF AND APPARATUS FOR CLAMPING THE UNDERWINDING THREAD OF A SPINNING SPINDLE

(75) Inventors: Friedrich Dinkelmann, Rechberghausen; Gerhard Darcis, Wiesensteig; Peter Mann, Süssen, all of (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/497,428

(22) Filed: Feb. 3, 2000

(30) Foreign Application Priority Data

Feb. 5, 1999 (DE) ..... 199 04 793

(51) Int. Cl.[7] ..... D01H 13/10
(52) U.S. Cl. ..... 57/299; 57/303
(58) Field of Search ..... 57/75, 131, 135, 57/129, 261, 269, 278, 279, 299, 300, 303; 242/474.2, 473.7, 473.8, 487.6

(56) References Cited

U.S. PATENT DOCUMENTS 652,725 * 6/1900 Roney ..... 57/135
2,428,081 * 9/1947 Keight et al. ..... 57/135
4,617,791 * 10/1986 Lousberg ..... 57/299
4,796,422 * 1/1989 Odawara ..... 57/299
5,581,989 * 12/1996 Mann et al. ..... 57/129
6,085,511 * 7/2000 Dinkelmann et al. ..... 57/135

FOREIGN PATENT DOCUMENTS

2931209 * 2/1980 (DE) ..... 57/299
42 21 676 1/1994 (DE) .
43 37 100 4/1995 (DE) .
19628826 * 1/1998 (DE) ..... 57/299
292856 * 5/1988 (EP) ..... 57/299
358032 * 8/1989 (EP) ..... 57/299
587526 * 7/1993 (EP) ..... 57/299
0 775 769 5/1997 (EP) .

* cited by examiner

*Primary Examiner*—Danny Worrell
(74) *Attorney, Agent, or Firm*—Herbert Dubno

(57) ABSTRACT

Below a ring-spinning spindle, a clamping ring and a clamping sleeve have frustoconical surfaces, at least of one first textured to increase the grip on an underwinding thread. The clamping sleeve, for example, may be spring-biased to axially engage the clamp and force may be required to open the clamp.

8 Claims, 1 Drawing Sheet

METHOD OF AND APPARATUS FOR CLAMPING THE UNDERWINDING THREAD OF A SPINNING SPINDLE

FIELD OF THE INVENTION

The present invention relates to an apparatus for clamping an underwinding thread at a spindle of a ring-spinning machine whereby, associated with each spindle and below the cop or bobbin which is fitted thereon or may form thereon, a clamping device is provided.

The invention is particularly applicable to ring-spinning machines having a spindle rail provided with a multiplicity of spindles driven by respective drives, a ring rail movable up and down along the spindle of the row, respective travellers orbiting the bobbin or cop on the ring and guide means, e.g. a thread-guide eye above the cop or bobbin feeding the thread or yarn, usually from a drafting frame or from bobbins in a creel, to the ring-spinning station. The thread is twisted as it is applied to the cop and at the conclusion of winding, an underthread is provided which can be engaged, according to the invention, in a clamping device below the cop.

More particularly, the invention relates to the clamping device which can have a clamping ring which is axially fixed with respect to the cop and hence the spindle, a clamping sleeve which is axially movable with respect to the ring, the ring and spindle having frustoconical surfaces between which the underwinding thread is engaged. Preferably the underwinding thread loops around the spindle through less than 360° and the actuation device for the axially-movable sleeve is fixed on the ring-spinning machine.

BACKGROUND OF THE INVENTION

A prior art system of the aforedescribed type is found in EP 0 775 769 A1. In that system the underwinding thread is engaged between conical surfaces of a clamping ring and a clamping sleeve, the frustoconical surfaces being so constructed that they are self-locking when they are interengaged. In practice, however, soiling of the surfaces prevents reliable engagement of such a clamp.

OBJECTS OF THE INVENTION

It is the principal object of the present invention to improve the reliability of a system of the latter type and especially the clamping effectiveness.

Another object of the invention is to provide an apparatus for clamping an underwinding thread at the spindle of a ring-spinning machine whereby the clamping effectiveness is improved.

Still another object of the invention is to provide an apparatus for the purposes described which will be free from drawbacks of earlier clamping devices or roving machines and especially can result in an improvement in overall reliability.

Finally, it is an object of the invention to provide a method of operating a clamping device for a spindle of a ring-spinning machine that will ensure more reliable operation without a material increase in the cost thereof.

SUMMARY OF THE INVENTION

These objects are attained, in accordance with the present invention in an apparatus for clamping underwinding thread on a spindle of a ring-spinning machine which comprises:

below a cop fitted onto the spindle, an axially fixed clamping ring on the spindle, and an axially shiftable clamping sleeve on the spindle juxtaposed with the clamping ring, the clamping ring and the clamping sleeve having frustoconical clamping surfaces fitting one into another for engaging an underwinding thread between them upon axial shifting of the clamping sleeve toward the ring and releasing the underwinding thread upon axial shifting of the clamping sleeve away from the clamping ring, at least one of the surfaces being textured to effect increased retention of the underwinding thread upon clamping of the underwinding thread between the surfaces.

The method of the invention can comprise the steps of:

shifting an underwinding thread from a smaller diameter portion to a larger diameter portion of the clamping ring, thereby laying the underwinding thread between the surfaces of which at least one of the surfaces has been textured to effect increased retention of the underwinding thread upon clamping of the underwinding thread between the surfaces;

then clamping the underwinding thread between the surfaces by axially shifting the clamping sleeve toward the ring;

thereafter releasing the underwinding thread by axially shifting the clamping sleeve away from the ring; and causing the underwinding thread to migrate upon release to a smaller diameter portion of the ring and centrifugally casting the released thread from the ring.

According to the invention, therefore, a clamping surface of the clamping ring and/or a clamping surface of the clamping sleeve are textured to have a greater coefficient of sliding friction against the thread. The texturing can be with the formation of grooves, teeth, zig-zags or meanders, milling or knurling as may be required. In many cases, the structuring can be so fine that it is practically only a roughening of the respective clamping surface. The effect which is utilized according to the invention can be attained with the texturing of only one of the two juxtaposed surfaces forming the clamp although texturing can be provided on both surfaces if desired.

In DE 298 21 679 U1 substantially planar clamping surfaces are moved together and are provided with a corrugated structure which, however, does not increase the friction retention of the threading but is designed to open the gap between two relatively rotatable members to permit release of the thread when the two members are so rotated. Here the corrugation acts as camming elements. According to a feature of the invention the texturing is provided on both the clamping sleeve and on the clamping ring and the two are interfitted, means being provided for securing the ring and sleeve against the relative axial displacement.

A further feature of the invention provides that at least one element of the clamping device is elastic so that the clamping sleeve and ring are held in the clamped or engaged position by spring force.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
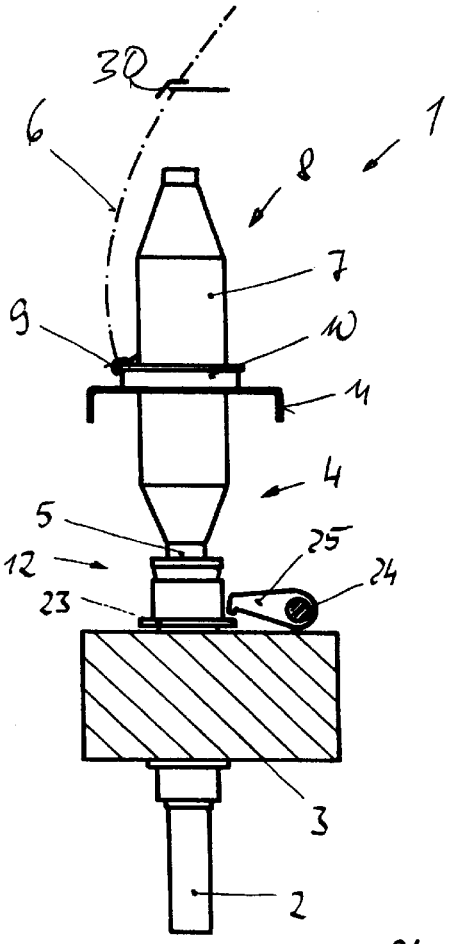
FIG. 1 is an axial section through the spindle rail of a ring-spinning apparatus having a multiplicity of spindles showing only one of these spindles and application of the invention as applied thereto.
Figure 2:
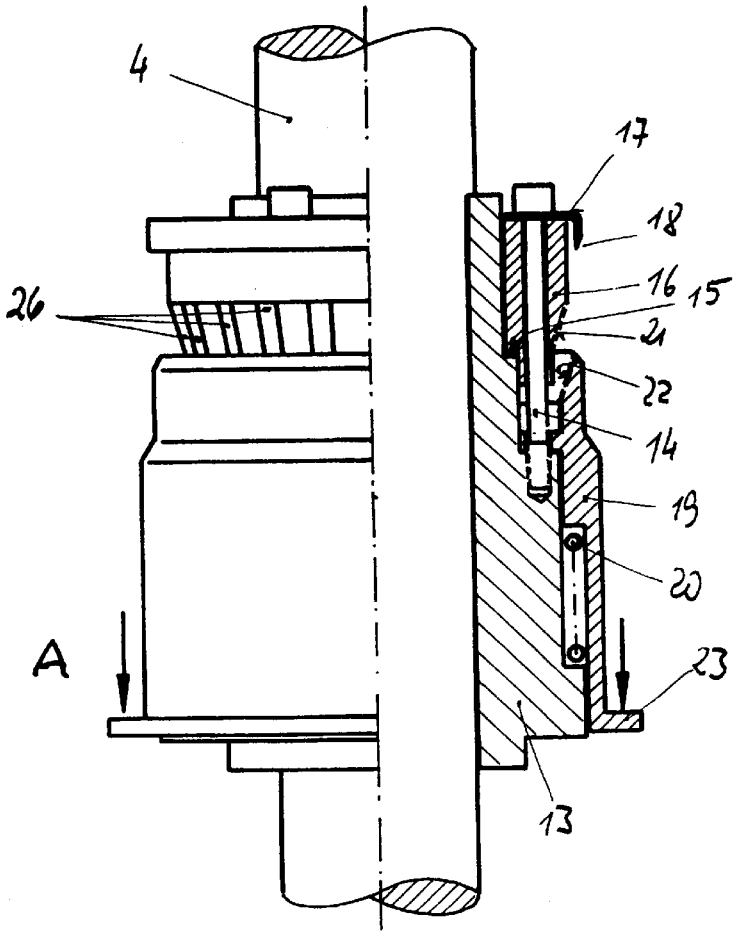
FIG. 2 is a detail of the clamping device, partly broken away and drawn to a larger scale.

At its upper portion, the spindle is formed with a clamping ring 16 which is easily replaced on the bushing, being held there by screws 14 engageable with a shoulder 15 of the clamping ring. The outer periphery of the clamping ring is slightly frustoconical. The screws 14 can also hold a cutting blade 17 with a sharp cutting edge 18 in place. When a thread or yarn is pulled against the blade, it is severed.

On the bushing 13 there is also a clamping sleeve 19 which is axially shiftable and is pressed upwardly by a spring 20 acting against the shoulder 30 which is axially shiftable and is pressed upwardly by spring 20 acting against the shoulder of the bushing 13 and a shoulder within the clamping sleeve.

The upper inner edge of the clamping sleeve is of frustoconical inner configuration to match the frustoconical outer periphery of the clamping ring 16.

The two frustoconical surfaces 21 and 22 of the clamping ring 16 and the clamping sleeve 12 together form the clamping device 12 in which the thread 6 is clamped and held. The screws 14 pass through a shoulder of the clamping sleeve 19 and thus hold the ring 16 and the axially movable clamping sleeve 19 in angular orientation against relative rotation.

The clamping sleeve 19 has an outer shoulder 23 which can be acted upon by an actuator for opening and closing the clamp. As shown in FIG. 1 this actuator can be a shaft 24 extending along the row of spindles and having respective arms 25 which press against the respective shoulders 23. Application of a force in the direction of arrow A against the force of the spring 20 releases yarn which is clamped at 12.

After the bobbin 8 has been formed and as the bobbin slows down, the clamping sleeve 19 is pressed downwardly to separate the surfaces 21 and 22 and open the clamp. After half or a third of a rotation, the ring rail 11 has moved sufficiently downwardly that the thread 6 from the traveller 9 has been placed at a certain angle to the periphery upon the clamp ring 16. After the spindle has been brought fully to standstill, the force in the direction of arrow A is removed so that the spring 20 displaces the clamping sleeve 19 upwardly and the surfaces 22 and 21 grip the thread between them. The thread is then held in the clamping device.

Figure 3:
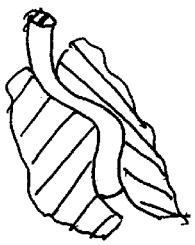
FIGS. 3 and 4 are cross sectional views showing various configurations of the texturing greatly enlarged.

After replacement of the full bobbin by an empty sleeve, spinning is begun again. While the thread end is held by the clamping device winding on the sleeve is begun. The thread held in the clamping device is then released. To ensure secure clamping at least one of the surfaces 21 or 22 and preferably both of them is provided with texturing as has been represented at 26. This can be in the form of a corrugation (FIG. 3) whose crests and troughs alternate with one another and interengage between the textured parts of the surfaces 21 and 22.

Figure 4:
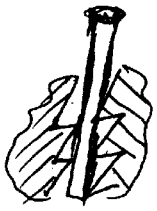

The corrugations can lie along lines which intersect the axes of the spindle or the apex of the imaginary cone of the surfaces. The screws 14 prevent relative rotation of the clamping ring 16 and the sleeve 19 so that the original positions of the crests and troughs vis-a-vis one another remain. The texturing can also be in the form of teeth or tooth arrays, as shown, for example, in FIG. 4. In many cases, only one of the two surfaces 21 and 22, for example, that of the clamping ring 16, can be provided with the texturing while the other surface is smooth. In this case, a system to prevent relative rotation need not be used.

In other cases it may be desirable to effect the texturing simply by roughening one or both of the surfaces, e.g. by sandblasting to obtain a surface resembling that of a nail file.

When one of the clamping elements (FIG. 16 or 19) is elastic or composed of yieldable synthetic resin material, other clamping elements can be incorporated to form the texturing or to provide the texturing. These elements can themselves be textured or can act collectively as a textured structure.

We claim:

1. An apparatus for clamping an underwinding thread on a spindle of a ring-spinning machine and which comprises, below a cop fitted onto said spindle, an axially fixed clamping ring on said spindle, and an axially shiftable clamping sleeve on said spindle juxtaposed with said clamping ring, said clamping ring and said clamping sleeve having frustoconical clamping surfaces fitting one into another for engaging an underwinding thread between them upon axial shifting of said clamping sleeve toward said ring and releasing said underwinding thread upon axial shifting of said clamping sleeve away from said clamping ring, at least one of said surfaces being textured to effect increased retention of said underwinding thread upon clamping of said underwinding thread between said surfaces.

2. The apparatus defined in claim 1 wherein said one of said surfaces is corrugated to form texturing increasing retention of said underwinding thread.

3. The apparatus defined in claim 1 wherein said one of said surfaces is provided with sharp-edged teeth to form texturing increasing retention of said underwinding thread.

4. The apparatus defined in claim 1 wherein both of said surfaces are formed with textured portions engaging in one another, said apparatus further comprising means for preventing relative rotation of said ring and said sleeve.

5. The apparatus defined in claim 1 wherein the texturing is formed by a roughened portion of said one of said surfaces.

6. The apparatus defined in claim 1 wherein at least a part of at least one of said clamping ring and said clamping sleeve is elastic.

7. The apparatus defined in claim 1, further comprising a spring biasing said sleeve toward said ring.

8. A method of clamping an underwinding thread of a spindle of a ring spinning machine wherein below a cop fitted onto said spindle, an axially fixed clamping ring is provided on said spindle, and an axially shiftable clamping sleeve on said spindle is juxtaposed with said clamping ring, said clamping ring and said clamping sleeve having frustoconical clamping surfaces fitting one into another for engaging an underwinding thread between them upon axial shifting of said clamping sleeve toward said ring and releasing said underwinding thread upon axial shifting of said clamping sleeve away from said clamping ring, said method comprising the steps of:

shifting an underwinding thread from a smaller diameter portion to a larger diameter portion of the clamping ring, thereby laying the underwinding thread between said surfaces of which at least one of said surfaces has been textured to effect increased retention of said underwinding thread upon clamping of said underwinding thread between said surfaces;

then clamping said underwinding thread between said surfaces by axially shifting said clamping sleeve toward said ring;

thereafter releasing said underwinding thread by axially shifting said clamping sleeve away from said ring; and causing said underwinding thread to migrate upon release to a smaller diameter portion of said ring and centrifugally casting the released thread from the ring.

* * * * *